US010651586B2

(12) United States Patent
Christiano et al.

(10) Patent No.: US 10,651,586 B2
(45) Date of Patent: May 12, 2020

(54) ELECTRICAL CONNECTOR WITH MACHINE-READABLE GRAPHIC IDENTIFIER

(71) Applicants: TYCO ELECTRONICS BRASIL LTDA, Braganca Paulista (BR); Tyco Electronics Canada ULC, Markham (CA); TE CONNECTIVITY CORPORATION, Berwyn, PA (US)

(72) Inventors: Fabio Fortunato Christiano, São Paulo (BR); Zoran Krnetic, Mississauga (CA); Jeremy Christian Patterson, Winston-Salem, NC (US)

(73) Assignees: Tyco Electronics Brasil LTDA, Braganca Paulista (BR); Tyco Electronics Canada ULC, Markham (CA); TE Connectivity Corporation, Berwyn, PA (US)

( * ) Notice: Subject to any disclaimer, the term of this patent is extended or adjusted under 35 U.S.C. 154(b) by 0 days.

(21) Appl. No.: 15/995,611

(22) Filed: Jun. 1, 2018

(65) Prior Publication Data

US 2019/0372262 A1 Dec. 5, 2019

(51) Int. Cl.
*H01R 13/436* (2006.01)
*H01R 13/46* (2006.01)

(52) U.S. Cl.
CPC ..... *H01R 13/436* (2013.01); *H01R 13/465* (2013.01)

(58) Field of Classification Search
CPC ..... H01R 13/436; H01R 13/465
USPC ..... 439/489
See application file for complete search history.

(56) References Cited

U.S. PATENT DOCUMENTS

| | | | | |
|---|---|---|---|---|
| 6,471,527 | B2 * | 10/2002 | Fukamachi | H01R 13/62938 439/157 |
| 7,322,138 | B2 | 1/2008 | Gormley et al. | |
| 7,413,479 | B1 * | 8/2008 | Volpone | H01R 13/506 174/138 F |
| 9,583,860 | B1 * | 2/2017 | DeWitte | H01R 13/436 |
| 9,748,695 | B2 | 8/2017 | Gibeau | |
| 2002/0022391 | A1 * | 2/2002 | Beck, Jr. | H01R 13/62938 439/157 |
| 2007/0238336 | A1 * | 10/2007 | Frederiksen | H01R 13/62955 439/157 |
| 2009/0163043 | A1 * | 6/2009 | Demers | G02B 6/4452 439/43 |

(Continued)

FOREIGN PATENT DOCUMENTS

| | | | |
|---|---|---|---|
| DE | 202008013609 | U1 | 11/2009 |
| DE | 202009003250 | U1 | 7/2010 |

OTHER PUBLICATIONS

International Search Report, International Application No., PCTIB2019/054147, International Filing Date, May 20, 2019.

*Primary Examiner* — Harshad C Patel

(57) ABSTRACT

An electrical connector includes a housing and a presentation block. The presentation block is mounted to the housing along an outer surface of the housing. The presentation block has a three-dimensional shape with a display surface that is angled transverse to an area of the outer surface of the housing on which the presentation block is mounted. The presentation block includes a graphic identifier that is computer-readable and disposed on the display surface.

21 Claims, 6 Drawing Sheets

(56) References Cited

U.S. PATENT DOCUMENTS

| | | | | |
|---|---|---|---|---|
| 2015/0211581 | A1* | 7/2015 | Murphy | G01H 1/003<br>340/682 |
| 2015/0318640 | A1* | 11/2015 | Gibeau | H01R 24/28<br>439/489 |
| 2019/0029445 | A1 | 1/2019 | Robertson | |

* cited by examiner

ELECTRICAL CONNECTOR WITH MACHINE-READABLE GRAPHIC IDENTIFIER

BACKGROUND

The subject matter herein relates generally to electrical connector systems, and more specifically to electrical connectors that have machine-readable graphic identifiers for tracking and recording purposes.

Some electrical connectors include machine-readable graphic identifiers that are used to record and log a presence, position, characteristic, or the like of the electrical connectors during a manufacturing process or an assembly process. For example, in the assembly of an automobile, an operator may be tasked with using a reader device, such as a scanner or an imager, to "read" graphic identifiers on various electrical connectors that are installed into the automobile. A positive read on a specific electrical connector may provide certain information that is recorded and logged. For example, a positive read may indicate the presence and location of the connector, as well as verifying that the connector is fully mated to a complementary mating connector. For large and/or complex products, such as automobiles, verifying and recording that certain tasks are completed may be useful to reduce errors during the assembly process and to identify and rectify problems that arise later in the assembly process and after the product has been sold.

One issue with known electrical connectors that have machine-readable graphic identifiers is that reader devices may be unable to read the graphic identifier, causing a no-read result, due to the physical position and orientation of the reader device relative to the graphic identifier. Some reader devices can only decode or read a graphic identifier if the graphic identifier within a specific a range of focal distances, angles, and orientations relative to the reader device. But, due to limited tool clearance within the assembly environment, it may be difficult or impossible for an operator to position the reader device such that the reader device is able to read the graphic identifier. If the reader device is not able to read the graphic identifier, then the information provided by the graphic identifier is not able to be logged and recorded. In situations in which the graphic identifiers of numerous connectors are read to verify that the connectors are fully mated, the inability to read the graphic identifier on a fully mated connector may produce a false negative that is incorrectly interpreted as the connector not being fully mated.

A need remains for an electrical connector that has a graphic identifier that can be read by reader device along a greater range of angles than known connectors, in order to reduce the occurrence of no-read results in assembly environments with limited tool clearance.

SUMMARY

In at least one embodiment, an electrical connector is provided that includes a housing and a presentation block. The presentation block is mounted to the housing along an outer surface of the housing. The presentation block has a three-dimensional shape with a display surface that is angled transverse to an area of the outer surface of the housing on which the presentation block is mounted. The presentation block includes a graphic identifier that is computer-readable and disposed on the display surface.

In at least one embodiment, an electrical connector is provided that includes a housing, a presentation block, and a connector position assurance (CPA) device. The presentation block is mounted on the housing along an outer surface of the housing. The presentation block has a three-dimensional shape with a display surface that is angled transverse to an area of the outer surface of the housing on which the presentation block is mounted. The presentation block includes a graphic identifier that is computer-readable and disposed on the display surface. The CPA device is mounted on the housing and movable relative to the housing between a lock position and an unlock position. The CPA device in the unlock position at least partially conceals the graphic identifier of the presentation block to prevent the graphic identifier from being read by a reader device. The graphic identifier is exposed when the CPA device is in the lock position. The CPA device is configured to be movable from the unlock position to the lock position only when the housing is in a fully mated position relative to a mating connector.

In at least one embodiment, an electrical connector is provided that includes a housing and a presentation block. The presentation block is mounted on the housing along an outer surface of the housing. The presentation block has a three-dimensional shape with a first display surface and a second display surface that are angled transverse to each other. Each of the first and second display surfaces is angled transverse to an area of the outer surface of the housing on which the presentation block is mounted. The presentation block includes a graphic identifier disposed on at least one of the first and second display surfaces. The graphic identifier is a computer-readable code that identifies the electrical connector.

DETAILED DESCRIPTION

Figure 1:
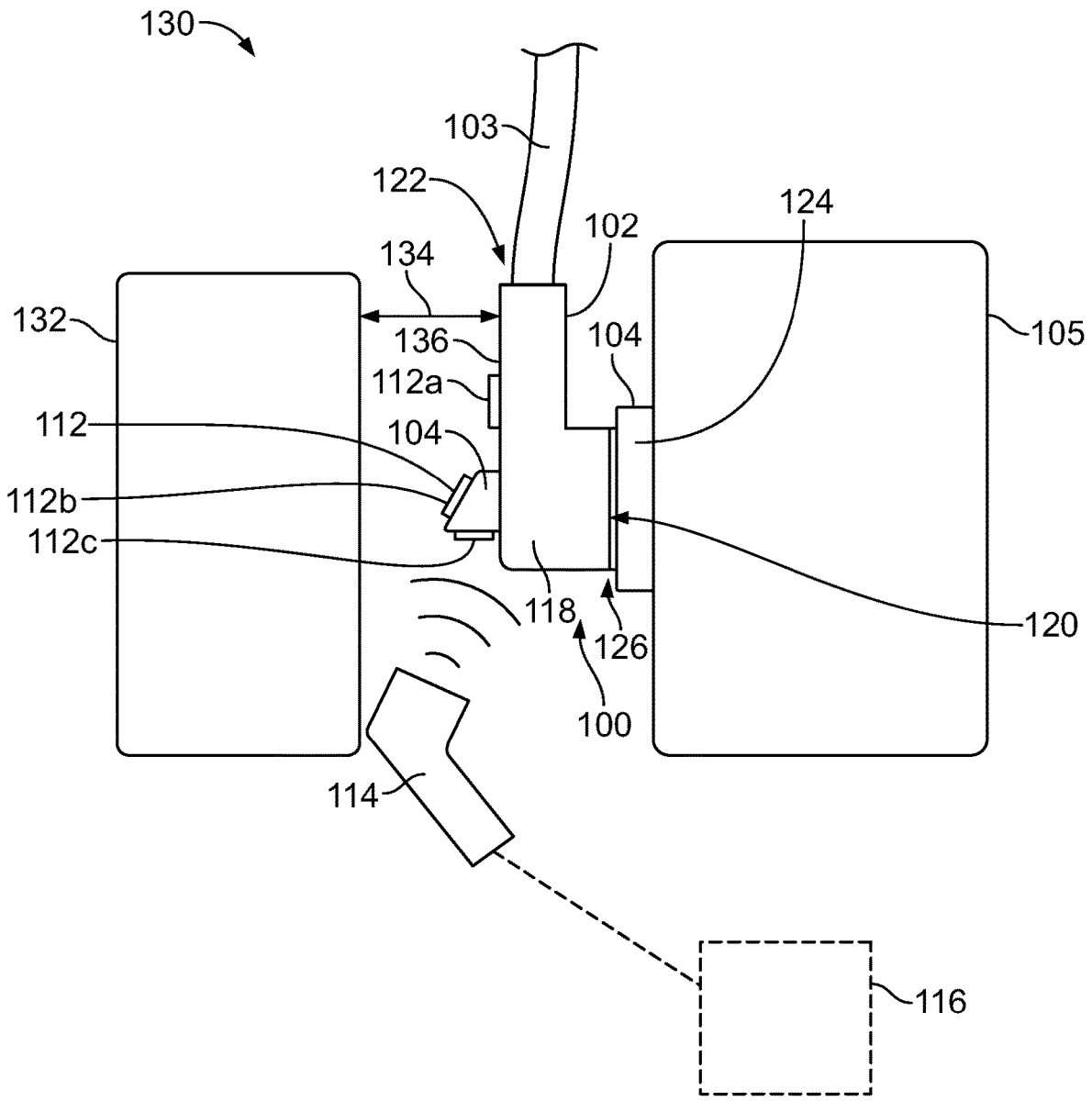
FIG. 1 is a schematic view of an electrical connector system within an assembly environment according to an embodiment.

FIG. 1 is a schematic view of an electrical connector system 100 within an assembly environment 130 according to an embodiment. The electrical connector system 100 includes a first connector 102 and a second connector 104. In FIG. 1, the first connector 102 is mated to the second connector 104. The first connector 102 is shown as a cable-mounted connector that has at least one cable or wire 103 projecting from the first connector 102. The second connector 104 in FIG. 1 is a header connector mounted to a structure 105. The structure 105 may be an electrical device (e.g., a server, a computer, a circuit board, or the like), a mechanical housing or case, or the like. In an alternative embodiment, both connectors 102, 104 are cable-mounted or both connectors 102, 104 are structure-mounted.

The first connector 102 has a housing 118 that includes a mating end 120 and a cable end 122. The mating end 120 of the housing 118 engages a housing 124 of the second connector 104 to define a mating interface 126. The one or more cables 103 project from the housing 118 at the cable end 122. The housing 118 in the illustrated embodiment has a right angle configuration such that the cable end 122 is not opposite from the mating end 120. The mating end 120 is oriented along a plane that is transverse (e.g., perpendicular) to a plane along the cable end 122. The housing 118 may have a linear or in-line configuration in an alternative embodiment. Although not shown, the housing 118 holds one or more electrical contacts that are electrically terminated (e.g., connected) to conductive wires in the one or more cables 103. The contacts of the first connector 102 electrically connect to mating contacts (not shown) of the second connector 104 to establish a conductive signal pathway across the mating interface 126.

In the illustrated embodiment, the first connector 102 has multiple machine-readable graphic identifiers 112 mounted on the housing 118. The graphic identifiers 112 are coded indicia that represent information. For example, although not shown in FIG. 1, the graphic identifiers 112 may be barcodes, such as one-dimensional (e.g., linear) barcodes or two-dimensional (e.g., matrix) barcodes. The graphic identifiers 112 provide information about the first connector 102. For example, the graphic identifiers 112 may identify the first connector 102 by providing a serial number, a part number, or the like. The graphic identifiers 112 optionally may also identify the product on which the first connector 102 is supposed to be installed, such as a model of automobile or a specific component of an automobile, and/or may identify the type or model of mating connector with which the first connector 102 is compliant.

The first and second connectors 102, 104 are mated to one another within the assembly environment 130. The assembly environment 130 includes various devices and structures, such as the structure 105 and an adjacent structure 132. It may be useful to record that the first and second connectors 102, 104 are mated, such as to track progress during an assembly process and for verification if a question or issue arises later regarding whether the first and second connectors 102, 104 had been mated.

An operator or a robot may be tasked with manipulating a reader device 114 to read at least one graphic identifier 112 on the first connector 102. As used herein, the reader device 114 "reads" a graphic identifier by decoding and deciphering the information contained in the graphic identifier 112. The reader device 114 may be a scanner, a sensor, an imager, or the like. For example, the reader device 114 may have a light source (e.g., a laser emitter) and a photodetector that is able to interpret light that reflects off of one of the graphic identifiers 114. Optionally, the reader device 114 may include a camera.

The reader device 114 may be communicatively connected to a database 116 via a wired conductive pathway or a wireless communication link. Information obtained by the reader device 114 from the graphic identifier 112 can be transmitted to the database 116 for storage and/or to a communication device for remote transmission. The database 116 may be located on a tangible and non-transitory computer readable storage device. The storage device may be a computer memory, such as a Random Access Memory (RAM) or a hard disk drive, or the storage device may be a removable storage drive, such as a solid state device, an optical drive, an external hard drive, a flash drive, or the like.

The assembly environment 130 may be relatively dense or crowded with limited clearance for positioning the reader device 114 proximate to the graphic identifier 112 on the first connector 102. For example, there is a narrow clearance gap 134 defined between the first connector 102 and the adjacent structure 132. The narrow clearance gap 134 is not wide enough accommodate the reader device 114 for reading the graphic identifiers 112.

The first connector 102 has a first graphic identifier 112*a*, a second graphic identifier 112*b*, and a third graphic identifier 112*c*. The first, second, and third graphic identifiers 112*a*, 112*b*, 112*c* may be duplicates of each other, such that all three identifiers 112*a*, 112*b*, 112*c* represent the same information. The first graphic identifier 112*a* is disposed directly on the housing 118 along a back side 136 of the housing 118. The back side 136 of the housing 118 is opposite the mating end 120, and faces away from the mating end 120.

The first graphic identifier 112*a* lays flat on the back side 136 of the housing 118. In FIG. 1, the reader device 114 is outside of the clearance gap 134 because there is insufficient space to fit the reader device 114 within the clearance gap 134. At the position in FIG. 1, the angle of incidence from a line normal to the first graphic identifier 112*a* may be too large for the reader device 114 to be able to read the first graphic identifier 112*a*. The reader device 114 cannot read the first identifier 112*a* in the position shown in FIG. 1, and would likely also not be able to reader the first identifier 112*a* if the reader device 114 was moved to the other end of the structures 105, 132, adjacent to the cable 103. Although not the case in the illustrated embodiment, if the first graphic identifier 112*a* was the only identifier on the first connector 102, then the reader device 114 would potentially not bot able to read and record the information from the first connector 102. For example, if reading the graphic identifier 112*a* is used to verify and log that the first connector 102 is mated to the second connector 104, then no verification occurs.

The first electrical connector 102 includes a presentation block 140 mounted to the housing 118. The presentation block 140 has a three-dimensional shape and projects outward from the back side 136 of the housing 118 (e.g., away from the mating end 120). The second and third graphic identifiers 112*b*, 112*c* are disposed on the presentation block 140 on different surfaces thereof. The second and third graphic identifiers 112*b*, 112*c* on the presentation block 140 are angled relative to the first graphic identifier 112*a*. In the position of the reader device 114 in FIG. 1, the reader device 114 is able to read the third graphic identifier 112*c*. For example, the angle of incidence between the reader device 114 and the third graphic identifier 112*c* is sufficiently small (e.g., less than 45 degrees or the like) to enable the reader device 114 to decipher the third graphic identifier 112*c*.

The three graphic identifiers 112*a-c* are angled relative to each other along different orientations to increase the scope or range of a viewing window at which the reader device 114 is able to read the information that is coded in the graphic identifiers 112*a-c*. The viewing window represents a scope or range of angles around the first connector 102. The reader device 114 is able to read the information from at least one of the identifiers 112*a-c* when the reader device 114 is in the viewing window. In a hypothetical example, if the first connector 102 only has the first graphic identifier 112*a*, the viewing window may extend 90 degrees around the first connector 102 in the area proximate to the first identifier 112*a*; but with all three graphic identifiers 112*a-c* at different orientations, the viewing window may be increased to 180 degrees around the first connector 102. For example, if the reader device 114 is moved to the other side of the structures 105, 132 in FIG. 1 adjacent to the cable 103, the reader device 114 may still be able to read the second graphic identifier 112*b* to obtain the information. The greater scope of the viewing window reduces the risk of no-read results due to positioning of the reader device 114 relative to the first connector 102.

In one or more embodiments described herein, the graphic identifiers 112 may be utilize for recordable position assurance. For example, the first connector 102 may be configured and designed such that the graphic identifiers 112 are concealed when the first connector 102 is not mated to the second connector 104, and are exposed (or at least exposable) when the first and second connectors 102, 104 are mated together. In FIG. 1, the first and second connectors 102, 104 are mated, and the graphic identifiers 112 are exposed such that the identifiers 112 are able to be read by the reader device 114 (if the reader device 114 is within the viewing window). As used herein, "exposable" means that the item is able to be exposed by a routine operation without requiring undue force that may damage one or more components. When the connectors 102, 104 are not mated, the graphic identifiers 112 may be concealed such that an obstruction on the first connector 102 blocks the reader device 114 from "viewing" a sufficient amount of any of the graphic identifiers 112 to read to decipher the information contained in the graphic identifiers 112. This mechanism provides recordable position assurance because the reader device 114 is only able to read and record a graphic identifier 112 on the first connector 102 when the connector 102 is mated, so the reading of a graphic identifier 112 is associated with the mated state or position. Conversely, a no-read result is associated with an un-mated state or position of the connector 102. The first connector 102 in the illustrated embodiment includes the three-dimensional presentation block 140 in order to eliminate or at least reduce the occurrence of no-read results that falsely indicate that the connectors 102, 104 are disconnected even though the connectors 102, 104 are actually mated.

Figure 2:
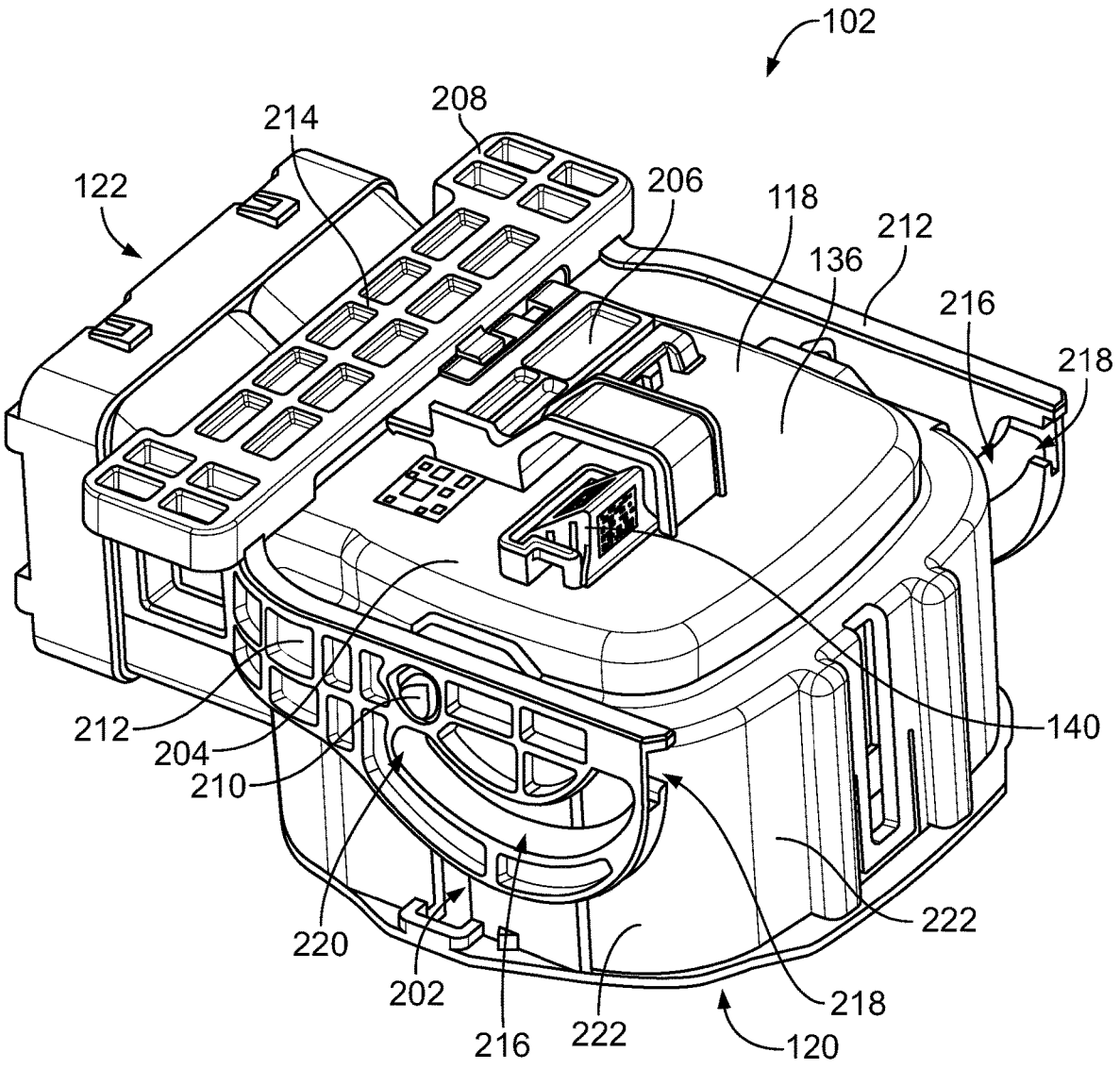
FIG. 2 is a perspective view of one connector of the connector system according to an embodiment.

FIG. 2 is a perspective view of the first connector 102 of the connector system 100 according to an embodiment. The first connector 102 is also referred to herein as "connector", and the second connector 104 (shown in FIG. 1) is referred to as "mating connector". The one or more cables 103 that extend from the cable end 122 of the connector 102 are omitted in FIG. 2. The housing 118 has a right angle shape that extends from the mating end 120 to the cable end 122. The housing 118 defines a cavity 202 that is open at the mating end 120 for receiving a portion of the mating connector 104 therein when mated. The housing 118 has an outer surface 204. The back side 136 of the housing 118 that is opposite the mating end 120 defines a portion of the outer surface 204. The housing 118 optionally may be a unitary, monolithic component that is formed via a molding process.

In the illustrated embodiment, the connector 102 includes a CPA device 206. The CPA device 206 is configured to provide assurance that the connector 102 is fully mated to the mating connector 104 (FIG. 1). For example, the CPA device 206 is movable between a lock position and an unlock position. The CPA device 206 is configured to be disposed in the unlock position when the connector 102 is not fully mated to the mating connector 104, such as if the connector 102 is mechanically spaced apart from the mating connector 104 and if the connector 102 is only partially mated to the mating connector 104. As described in more detail herein, the CPA device 206 may be restricted from moving from the unlock position to the lock position until the connector 102 is fully mated to the mating connector 104. Once the connectors 102, 104 are fully mated, a mechanical impediment is removed which allows the CPA device 206 to be moved by an operator or robotic machine to the lock position.

The CPA device 206 is in the lock position in FIG. 2. The lock position is associated with the connector 102 being fully mated to the mating connector 104, although the mating connector 104 is omitted in FIG. 2. When the CPA device 206 is in the lock position, the graphic identifiers 112*a-c* are exposed and can be read by the reader device 114 (FIG. 1).

The connector 102 optionally includes a lever 208 that provides a mating assist to reduce an amount of input force required to mate the connectors 102, 104. The lever 208 is pivotably coupled to the housing 118 via lugs or posts 210. The lever 208 has two arms 212 that couple to the lugs 210, and a handle 214 that extends between and connects to the arms 212. During mating, the lever 208 engages the mating connector 104 and pulls the mating connector 104 into the cavity 202 of the housing 118 as the lever 208 is pivoted. For example, the arms 212 of the lever 208 may define curved cam slots 216 that vary in proximity to the lugs 210 along the lengths of the cam slots 216. For example, each of the cam slots 216 extends from a respective open end 218 of the cam slot 216 to a respective closed end 220. The open end 218 is location farther from the lug 210 than the closed end 220. The open end 218 defines an entryway through which a post (not shown) of the mating connector 104 is received into the cam slot 216. Based on the direction in which the lever 208 is pivoted, the curved trajectories of the cam slots 216 pull the posts of the mating connector 104 towards the lugs 210 (for mating assist) or push the posts away from the lugs 210 (for un-mating assist). The handle 214 of the lever 208 may interact with the CPA device 206, as described herein.

The presentation block 140 is mounted on the housing 118 along the outer surface 204. The presentation block 140 has a three-dimensional shape and projects outward from the outer surface 204. In at least one embodiment, the presentation block 140 is a discrete component relative to the housing 118. For example, the presentation block 140 may be a loose piece that is removably mounted to the housing 118. In an alternative embodiment, the presentation block 140 may be non-removably mounted to the housing 118 via an adhesive, welding, soldering, or the like. The presentation block 140 is located on the back side 136 of the housing 118, but may be mounted along the outer surface 204 of other portions of the housing 118 in alternative embodiments, such as one or more side walls 222 that surround and define the cavity 202.

Figure 3:
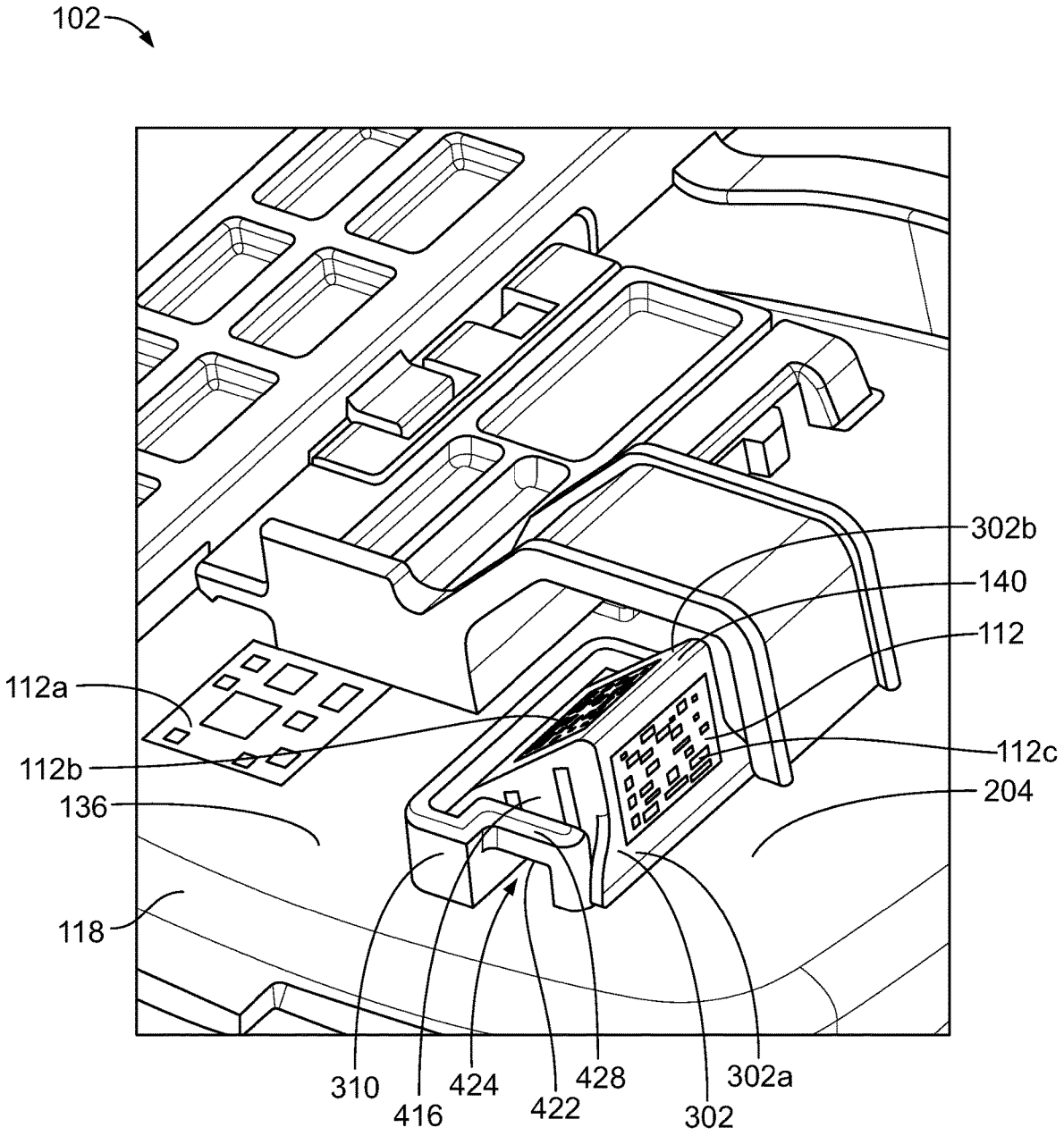
FIG. 3 is a close-up perspective view of a portion of the connector shown in FIG. 2 that includes a presentation block.

FIG. 3 is a close-up perspective view of a portion of the connector 102 shown in FIG. 2 that includes the presentation block 140. The presentation block 140 has at least one display surface 302 that is angled transverse to the outer surface 204 of the housing 118. As used herein, relative comparisons between surfaces of the presentation block 140 and the outer surface 204 of the housing 118 refers to an area of the outer surface 204 on which the presentation block 140 is mounted. For example, the at least one display surface 302 is angled transverse to the area of the outer surface 204 that is underneath (e.g., covered by) the presentation block 140 and immediately surrounding the perimeter of presentation block 140. In the illustrated embodiment, this area is along the back side 136 of the housing 118, which may be relatively flat and planar. Each display surface 302 of the presentation block 140 is characterized by having sufficient surface area to display a machine-readable graphic identifier 112 thereon. The display surfaces 302 may have sufficient surface area to support a square or rectangular graphic identifier 112. In a non-limiting example, the graphic identifier 112 may be a square having 1 cm sides. Each display surface 302 in the illustrated embodiment is planar, however one or more display surfaces 302 may have a convex curve or a concave curve in an alternative embodiment.

In the illustrated embodiment, the presentation block 140 has two display surfaces 302, including a first display surface 302*a* and a second display surface 302*b*. Both display surfaces 302*a*, 302*b* are oriented transverse to the outer surface 204 of the housing 118 when the presentation block 140 is mounted to the housing 118. The display surfaces 302*a*, 302*b* face outward away from each other. The display surfaces 302*a*, 302*b* are optionally oriented transverse to each other. As used herein, a "transverse" orientation between two surfaces indicates that the two surfaces are not parallel (e.g., the relative angle between the two surfaces is any angle other than 180 degrees). Both display surfaces 302*a*, 302*b* have a separate graphic identifier 112 disposed thereon. For example, the third graphic identifier 112*c* is disposed on the first display surface 302*a*, and the second graphic identifier 112*b* is disposed on the second display surface 302*b*. In an alternative embodiment, only one of the display surfaces 302*a*, 302*b* may have a graphic identifier 112 instead of both display surfaces 302*a*, 302*b*.

In the illustrated embodiment, the first display surface 302*a* is oriented perpendicular to the outer surface 204 of the housing 118, and the second display surface 302*b* has an oblique angular orientation relative to the outer surface 204. As used herein, the term "perpendicular" includes right angles (e.g., 90 angles) as well as a designated range of angles less than and greater than 90 degrees, such as 5 degrees or 10 degrees. For example, if the designated range is 10 degrees, the term "perpendicular" as used herein includes angles from 80 degrees to 100 degrees. As used herein, an "oblique" orientation between two surfaces indicates that the two surfaces are neither parallel nor perpendicular. As described above, the different orientations and positions of the graphic identifiers 112*a-c* on the housing 118 increase the range of angles at which the reader device 114 can read one of the graphic identifiers 112 on the connector 102. The first display surface 302*a* is also referred to herein as a "right angle display surface", and the second display surface 302*b* is also referred to herein as an "oblique display surface". In one or more alternative embodiments, both the first and second display surfaces 302*a*, 302*b* may be oriented perpendicular to the outer surface 204 of the housing 118 or both surfaces 302*a*, 302*b* may have oblique orientations relative to the outer surface 204.

The housing 118 may have a cradle 310 along the outer surface 204 to secure the presentation block 140 to the housing 118. The cradle 310 surrounds at least a portion of a perimeter of the presentation block 140, and the presentation block 140 mounts to the housing 118 within the cradle 310. In the illustrated embodiment, the cradle 310 is a wall or rail that projects outward from the outer surface 204 on the back side 136 of the housing 118.

Figure 4:
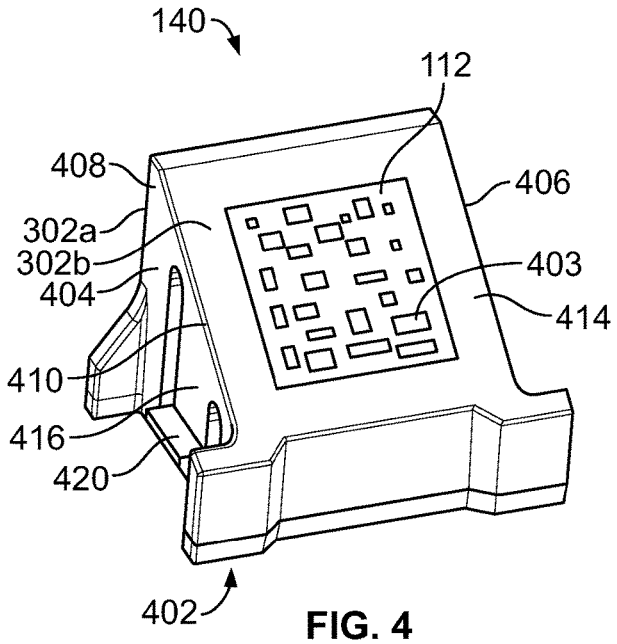
FIG. 4 is a first perspective view of the presentation block according to an embodiment showing an oblique display surface thereof.
Figure 5:
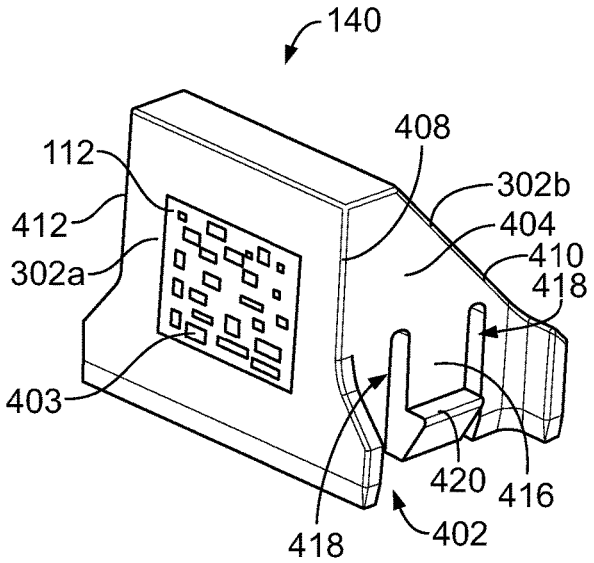
FIG. 5 is a second perspective view of the presentation block of FIG. 4 showing a right angle display surface thereof.
Figure 6:
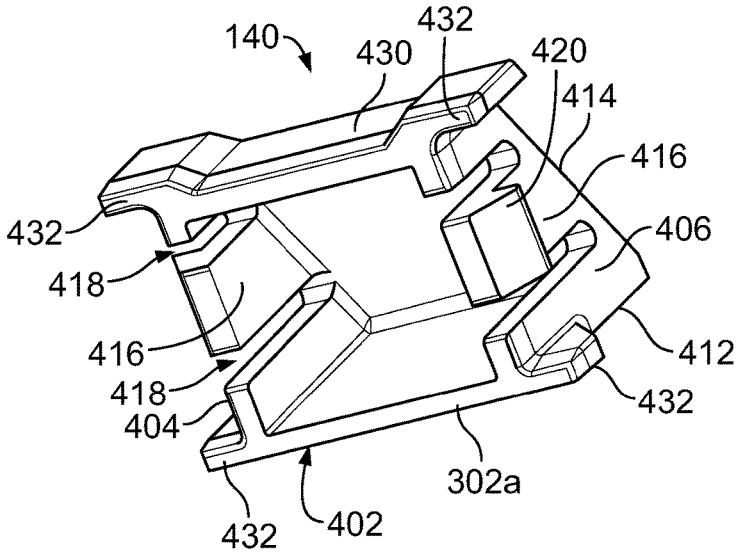
FIG. 6 is a third perspective view of the presentation block of FIGS. 4 and 5 showing a mounting end of the presentation block.

FIGS. 4-6 show different perspective views of the presentation block 140 of the connector 102 according to an embodiment. For example, FIG. 4 is a first perspective view showing the oblique display surface 302*b*. FIG. 5 is a second perspective view showing the right angle display surface 302*a*. FIG. 6 is a third perspective view showing a mounting end 402 (or side) of the presentation block 140. The mounting end 402 faces and may engage the outer surface 204 of the housing 118 when mounted to the housing 118.

The right angle display surface 302*a* and the oblique display surface 302*b* each have a discrete graphic identifier 112 (e.g., the identifiers 112*b* and 112*c* as shown in FIGS. 1 and 3) disposed thereon. The graphic identifiers 112 may be duplicate copies of each other, such that the same information is contained in each of the graphic identifiers 112. The graphic identifier 112 on the right angle display surface 302*a* is discrete and separate from the graphic identifier 112 on the oblique display surface 302*b*, such that the two graphic identifiers 112 are spaced apart from each other.

The graphic identifiers 112 show in FIGS. 2-5 are two-dimensional (or matrix style) barcodes that represent information or data using two-dimensional symbols and shapes, such as squares and/or rectangles 403. In an alternative embodiment, one or both of the graphic identifiers 112 may be a one-dimensional barcode that includes a series of parallel lines with varying widths and spacings to represent the information or data. In yet another alternative embodiment, one or both of the graphic identifiers 112 may be a three-dimensional barcode that also has a depth or height dimension as well as length and width dimensions. In other alternative embodiments, the graphic identifiers 112 may be other than barcodes, such as letters, shapes, colors, symbols, or the like.

The graphic identifiers 112 may be engraved onto the respective display surfaces 302*a*, 302*b* such that the graphic identifiers 112 are integrally formed onto the presentation block 140. For example, the lines of the graphic identifiers 112 may be etched directly into the material of the presentation block 140. Alternatively, the graphic identifiers 112 may be labels, stickers, or the like that formed separately from the presentation block 140 and subsequently applied onto the display surfaces 302 via an adhesive, a clear laminate material, welding, a clip or other fastener, or the like.

In the illustrated embodiment, the presentation block 140 includes two side walls 404, 406 that mirror each other on opposite sides of a line through the two display surfaces 302*a*, 302*b*. The side wall 404 connects to a first edge 408 of the right angle display surface 302*a* and a first edge 410 of the oblique display surface 302*b*. The side wall 406 connects to a second edge 412 of the right angle display surface 302*a* and a second edge 414 of the oblique display surface 302*b*. Both of the side walls 404 extend to the mounting end 402 of the presentation block 140. In the illustrated embodiment, each of the side walls 404, 406 includes a respective cantilevered latch feature 416. The latch features 416 are each defined by two slots 418 in the respective side wall 404, 406 that extend from the mounting end 402. The latch features 416 are generally planar with the respective side wall 404, 406, except for a hook tip 420 of each latch feature 416 that projects outward out of the plane of the respective side wall 404, 406.

With additional reference to FIG. 3, the hook tips 420 of the latch features 416 are configured to engage complementary catch features 422 on the cradle 310 to securely and removably mount the presentation block 140 on the housing 118. The cradle 310 defines apertures 424, and the catch features 422 are edges of rails 428 of the cradle 310. The edges face towards the outer surface 204 of the housing 118 and define segments of the apertures 424. For example, when the presentation block 140 is mounted to the housing 118, the latch features 416 deflect around the rails 428 until the hook tips 420 are received into the apertures 424 between the rails 428 and the outer surface 204 of the housing 118. The hook tips 420 of the latch features 416 engage the catch features 422 (e.g., the edges) of the rails 428 to block unintended removal of the presentation block 140 from the housing 118.

As shown in FIG. 6, the presentation block 140 optionally is hollow and does not have a wall at the mounting end 402. The mounting end 402 is defined by corresponding edges of the side walls 404, 406, the right angle display surface 302*a*, and an intermediate wall 430 that extends from the oblique display surface 302*b* to the mounting end 402. The presentation block 140 optionally also includes ribs 432 at the mounting end 402 disposed along different respective corners of the presentation block 140. The ribs 432 extend laterally outward away from the presentation block 140. The ribs 432 may be used for aligning and positioning the presentation block 140 relative to the housing 118, such as within the cradle 310 of the housing 118.

In one or more embodiments, the presentation block 140 is removably mountable to the housing 118 in more than one orientation. For example, the presentation block 140 may be able to be mounted in the cradle 310 in at least two different orientations relative to the housing 118.

Figure 7:
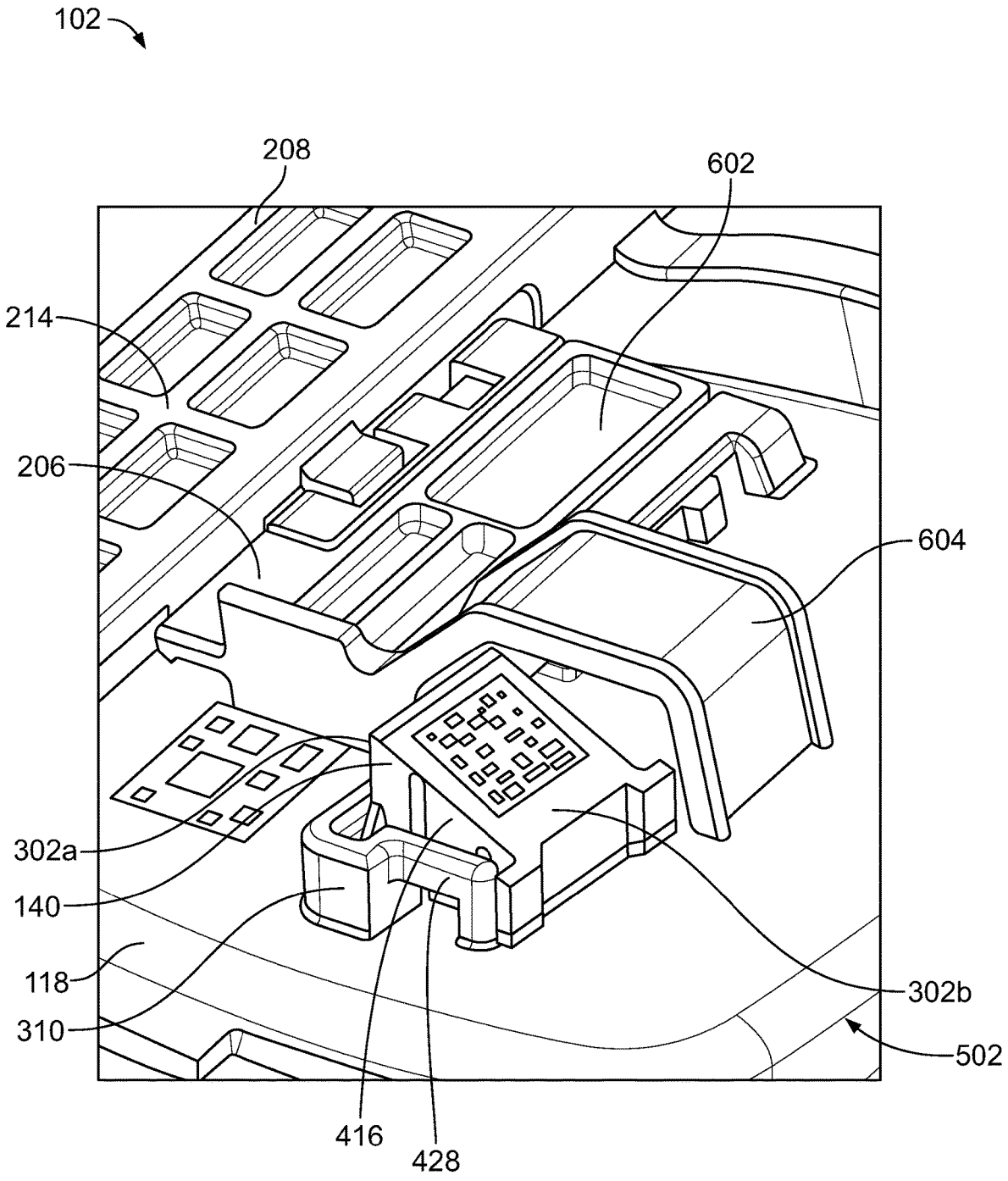
FIG. 7 is a close-up perspective view of the portion of the connector shown in FIG. 3 with the presentation block mounted in a different orientation than the orientation of the presentation block in FIG. 3.

FIG. 7 is a close-up perspective view of a portion of the connector 102 showing the presentation block 140 mounted to the housing 118 in a different orientation than the orientation of the presentation block 140 shown in FIG. 3. For example, in FIG. 3 the right angle display surface 302*a* faces generally towards a distal end 502 of the housing 118 that is opposite the cable end 122 (FIG. 2), and the oblique display surface 302*b* faces generally towards the cable end 122 (e.g., towards the first graphic identifier 112*a* and the handle 214 of the lever 208). In FIG. 7 the presentation block 140 is reversed within the cradle 310 such that the right angle display surface 302*a* faces generally towards the cable end 122, and the oblique display surface 302*b* faces generally towards the distal end 502. The presentation block 140 mounts to the cradle 310 in the same way in both orientations, with the only difference being that each individual latch feature 416 engages a different corresponding rail 428 of the cradle 310 for each orientation. In the illustrated embodiment the presentation block 140 is reversible such that the presentation block 140 is mountable to the housing 118 in two orientations that are 180 degrees apart from each other. In an alternative embodiment, the presentation block 140 and/or the cradle 310 may be designed to allow the presentation block 140 to mount to the housing 118 in more than two different orientations, such as in four different orientations that are 90 degrees apart.

Figure 8:
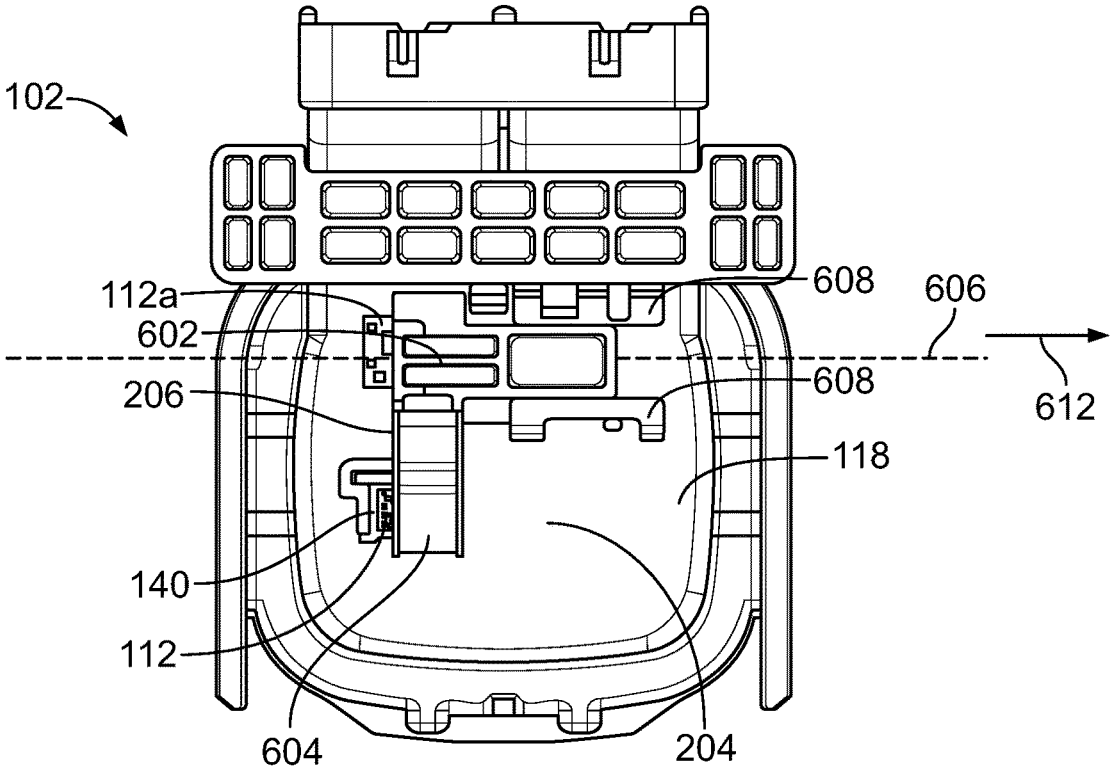
FIG. 8 is a top-down view of the connector showing a connector position assurance (CPA) device in an unlock position relative to a housing of the connector according to an embodiment.
Figure 9:
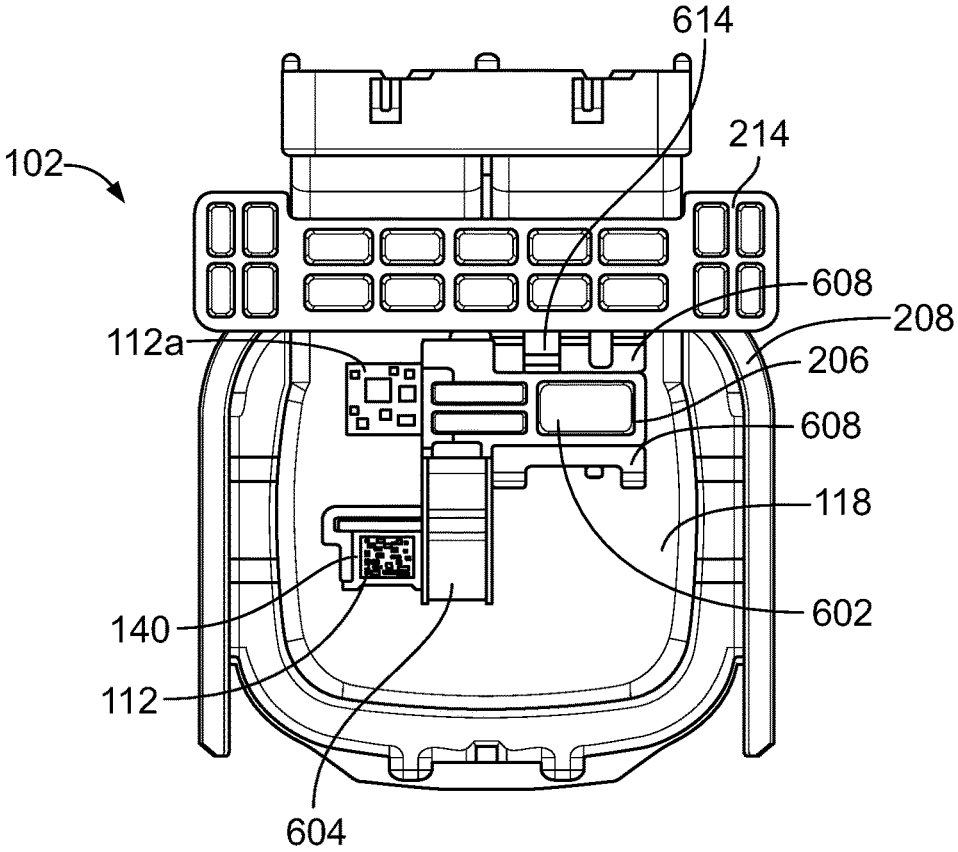
FIG. 9 is a top-down view of the connector showing the CPA device in a lock position relative to the housing.

FIG. 8 is a top-down view of the first connector 102 showing the CPA device 206 in the unlock position relative to the housing 118. FIG. 9 is a top-down view of the first connector 102 showing the CPA device 206 in the lock position relative to the housing 118. The CPA device 206 includes a main body 602 and an appendage 604 that projects from the main body 602. The main body 602 may be relatively flat and planar, and slides along the outer surface 204 of the housing 118 when actuated between the lock and unlock positions. The appendage 604 may extend out of the plane of the main body 602, as shown in more detail in FIG. 7, such that the appendage 604 hangs over the presentation block 140.

The CPA device 206 moves along a linear actuation axis 606 between the unlock position and the lock position. The movement of the CPA device 206 is guided by a CPA cradle 608 on the housing 118, which engages the main body 602. The main body 602 is spaced apart from the presentation block 140 in both the lock and unlock positions. In the unlock position of the CPA device 206, as shown in FIG. 8, the appendage 604 at least partially covers and conceals the graphic identifiers 112 on the presentation block 140. For example, the appendage 604 covers a sufficient percentage of the identifiers 112 that the reader device 114 (FIG. 1) is not able to read the identifiers 112 (regardless of the positioning of the reader device 114). In a non-limiting example, the appendage 604 covers at least 60% or at least 70% of the graphic identifiers 112, and the reader device 114 is not able to decipher the information contained in the identifiers 112 by viewing the visible portion of the identifiers 112. The main body 602 of the CPA device 206 may cover and conceal the first graphic identifier 112*a* that is mounted directly on the outer surface 204 of the housing 118. The CPA device 206 is moved in a locking direction 612 along the actuation axis 606 from the unlock position shown in FIG. 8 to the lock position shown in FIG. 9.

In the lock position shown in FIG. 9, the appendage 604 is spaced apart laterally from the presentation block 140 and does not conceal the graphic identifiers 112 on the presentation block 140. The main body 602 is also spaced apart from the first graphic identifier 112*a*. As a result, all of the graphic identifiers 112 on the connector 102 are exposed and able to be read by the reader device 114.

In an embodiment, the connector 102 is designed such that the CPA device 206 is movable from the unlock position shown in FIG. 8 to the lock position shown in FIG. 9 only when the connector 102 is fully mated to the mating connector 104 (FIG. 1). As a result, the graphic identifiers 112 are only exposed and able to be read by the reader device 114 when the connector 102 is fully mated. In the illustrated embodiment, the lever 208 in shown in a closed position relative to the housing 118, which is the position of the lever 208 when the connector 102 is fully mated to the mating connector 104. In an embodiment, the CPA device 206 is restricted from actuating from the unlock position shown in FIG. 8 to the lock position shown in FIG. 9, thereby exposing the graphic identifiers 112, unless the lever 208 is in the closed position. For example, the CPA device 206 may be restricted from moving to the lock position when the lever 208 is not in the closed position because a deflectable latch (not shown) of the CPA device 206 abuts the CPA cradle 608. When the lever 208 achieves the closed position, a tab 614 projecting from the handle 214 of the lever 208 deflects the latch of the CPA device 206 into a clearance position that allows the latch and the CPA device 206 to move in the locking direction 612 relative to the CPA cradle 608.

As used herein, relative or spatial terms such as "top," "bottom," "front," "back," "left," and "right" are only used to identify and distinguish the referenced elements and do not necessarily require particular positions or orientations relative to the surrounding environment of the electrical connector system 100.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely example embodiments. Many other embodiments and modifications within the spirit and scope of the claims will be apparent to those of ordinary skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. An electrical connector comprising:

a housing with an outer surface; and a presentation block mounted on the housing along the outer surface, the presentation block having a three-dimensional shape with a display surface that is angled transverse to an area of the outer surface of the housing on which the presentation block is mounted, the presentation block including a graphic identifier that is computer-readable and disposed on the display surface.

2. The electrical connector of claim 1, wherein the display surface has an oblique angular orientation relative to the area of the outer surface on which the presentation block is mounted.

3. The electrical connector of claim 1, wherein the display surface has a perpendicular orientation relative to the area of the outer surface on which the presentation block is mounted.

4. The electrical connector of claim 1, wherein the graphic identifier is one of a one-dimensional barcode or a two-dimensional barcode.

5. The electrical connector of claim 1, wherein the display surface of the presentation block is a first display surface and the presentation block includes a second display surface that is angled transverse to the area of the outer surface of the housing on which the presentation block is mounted, wherein the first and second display surfaces are angled transverse to each other.

6. The electrical connector of claim 5, wherein the graphic identifier is disposed on the first display surface and the presentation block includes a duplicate of the graphic identifier disposed on the second display surface.

7. The electrical connector of claim 5, wherein the first display surface has a perpendicular orientation relative to the area of the outer surface on which the presentation block is mounted, and the second display surface has an oblique angular orientation relative to the area of the outer surface.

8. The electrical connector of claim 7, wherein the graphic identifier is disposed on the first display surface and the presentation block includes a duplicate of the graphic identifier disposed on the second display surface.

9. The electrical connector of claim 1, further comprising a connector position assurance (CPA) device mounted on the housing and movable relative to the housing between a lock position and an unlock position, wherein the CPA device in the unlock position at least partially conceals the graphic identifier of the presentation block to prevent the graphic identifier from being read by a reader device, and wherein the graphic identifier is exposed when the CPA device is in the lock position.

10. The electrical connector of claim 9, wherein the CPA device includes a main body and an appendage that projects from the main body out of a plane of the main body, wherein the appendage at least partially conceals the graphic identifier on the display surface of the presentation block when the CPA device is in the unlock position and does not conceal the graphic identifier when the CPA device is in the lock position.

11. The electrical connector of claim 1, wherein the housing includes a cradle along the outer surface within which the presentation block mounts to the housing, wherein the presentation block is configured to mount within the cradle in at least two different orientations relative to the housing, wherein the display surface in each of the at least two different orientations faces away from the outer surface to enable a reader device to decipher the graphic identifier.

12. The electrical connector of claim 1, wherein the housing includes a cradle along the outer surface, the presentation block having latch features that engage complementary catch features of the cradle to removably mount the presentation block in the cradle of the housing.

13. An electrical connector comprising:

a housing with an outer surface;

a presentation block mounted on the housing along the outer surface, the presentation block having a three-dimensional shape with a display surface that is angled transverse to an area of the outer surface of the housing on which the presentation block is mounted, the presentation block including a graphic identifier that is computer-readable and disposed on the display surface; and a connector position assurance (CPA) device mounted on the housing and movable relative to the housing between a lock position and an unlock position, wherein the CPA device in the unlock position at least partially conceals the graphic identifier of the presentation block to prevent the graphic identifier from being read by a reader device, and wherein the graphic identifier is exposed when the CPA device is in the lock position, wherein the CPA device is configured to be movable from the unlock position to the lock position only when the housing is in a fully mated position relative to a mating connector.

14. The electrical connector of claim 13, wherein the CPA device includes a main body and an appendage that projects from the main body out of a plane of the main body, wherein the appendage at least partially conceals the graphic identifier on the display surface of the presentation block when the CPA device is in the unlock position and does not conceal the graphic identifier when the CPA device is in the lock position.

15. The electrical connector of claim 13, wherein the display surface of the presentation block is a first display surface and the presentation block includes a second display surface that is angled transverse to the area of the outer surface of the housing on which the presentation block is mounted, wherein the first and second display surfaces are angled transverse to each other.

16. The electrical connector of claim 13, wherein the graphic identifier is engraved on the display surface of the presentation block.

17. The electrical connector of claim 13, wherein the housing has a right angle shape that includes a mating end and a cable end, wherein the CPA device and the presentation block are mounted to the housing along a back side of the housing that is opposite the mating end, the back side facing away from the mating end.

18. The electrical connector of claim 13, wherein the housing includes a cradle along the outer surface within which the presentation block mounts to the housing, wherein the presentation block is configured to removably mount within the cradle in at least two different orientations relative to the housing, wherein the display surface in each of the at least two different orientations faces away from the outer surface to enable a reader device to decipher the graphic identifier.

19. An electrical connector comprising:

a housing with an outer surface; and a presentation block mounted on the housing along the outer surface, the presentation block having a three-dimensional shape with a first display surface and a second display surface that are angled transverse to each other, wherein each of the first and second display surfaces is angled transverse to an area of the outer surface of the housing on which the presentation block is mounted, wherein the presentation block includes a graphic identifier separately disposed on each of the first and second display surfaces, wherein the graphic identifier is a computer-readable code that identifies the electrical connector.

20. The electrical connector of claim 19, wherein the housing includes a cradle along the outer surface within which the presentation block mounts to the housing, wherein the presentation block is configured to removably mount within the cradle in at least two different orientations relative to the housing.

21. The electrical connector of claim 19, wherein the graphic identifier is one of a one-dimensional barcode or a two-dimensional barcode.

* * * * *